US008615915B2

(12) United States Patent
Hunter et al.

(10) Patent No.: US 8,615,915 B2
(45) Date of Patent: Dec. 31, 2013

(54) BULLPUP CONVERSION KIT FOR FIREARM

(75) Inventors: James Jeffrey Hunter, Jamestown, KY (US); Hanners R. Gevedon, Mount Vernon, KY (US); Rex McDonald, London, KY (US)

(73) Assignee: Bullpup Unlimited, Inc., Jamestown, NY (US)

( * ) Notice: Subject to any disclaimer, the term of this patent is extended or adjusted under 35 U.S.C. 154(b) by 323 days.

(21) Appl. No.: 13/114,466

(22) Filed: May 24, 2011

(65) Prior Publication Data

US 2011/0283582 A1 Nov. 24, 2011

Related U.S. Application Data

(60) Provisional application No. 61/396,190, filed on May 24, 2010.

(51) Int. Cl.
*F41C 23/12* (2006.01)

(52) U.S. Cl.
USPC ..... 42/72; 42/69.01; 89/136

(58) Field of Classification Search
USPC ..... 42/71.01, 72, 73, 75.03, 69.01; 89/27.3, 89/136, 132
See application file for complete search history.

(56) References Cited

U.S. PATENT DOCUMENTS

| | | | | |
|---|---|---|---|---|
| 2,970,398 | A * | 2/1961 | Crouch | 42/69.01 |
| 3,488,488 | A * | 1/1970 | Crouch | 42/146 |
| 3,512,290 | A * | 5/1970 | Violette, Jr. et al. | 42/75.01 |
| 4,463,654 | A | 8/1984 | Barnes et al. | |
| 4,601,123 | A | 7/1986 | Swearengen et al. | |
| 4,663,876 | A | 5/1987 | Reaume | |
| 4,677,781 | A | 7/1987 | Lee | |
| 4,869,008 | A | 9/1989 | Rasmussen | |
| 4,878,305 | A * | 11/1989 | Gabrielidis | 42/72 |
| 4,890,405 | A * | 1/1990 | Krouse | 42/75.03 |
| 6,374,528 | B1 | 4/2002 | Davis et al. | |
| 6,526,683 | B1 * | 3/2003 | Crandall | 42/40 |
| 7,337,574 | B2 | 3/2008 | Crandall et al. | |
| 7,356,958 | B2 | 4/2008 | Weir | |
| 7,634,959 | B2 | 12/2009 | Frickey | |
| 2006/0048426 | A1 | 3/2006 | Crandall | |
| 2010/0024273 | A1 * | 2/2010 | Duperry et al. | 42/69.01 |

FOREIGN PATENT DOCUMENTS

| | | | | |
|---|---|---|---|---|
| EP | 364905 | A1 * | 4/1990 | F41C 9/00 |

* cited by examiner

*Primary Examiner* — Benjamin P Lee
(74) *Attorney, Agent, or Firm* — King & Schickli, PLLC

(57) ABSTRACT

A bullpup conversion kit for a firearm includes a housing, a forward trigger assembly, a trigger actuator and a linkage connecting the forward trigger assembly with the trigger actuator. The trigger actuator includes a first locator plate, a second locator plate and a cam actuator positioned between the locator plates. The cam actuator includes a primary trigger engagement surface.

19 Claims, 13 Drawing Sheets

Fig. 16
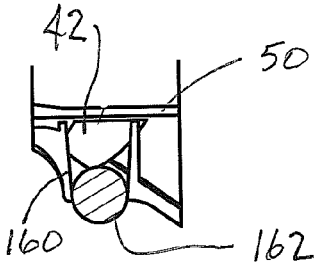
Fig. 17
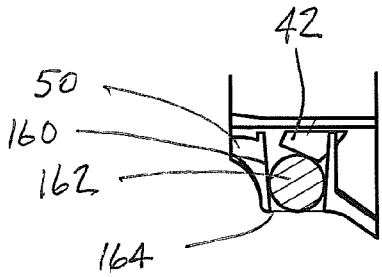
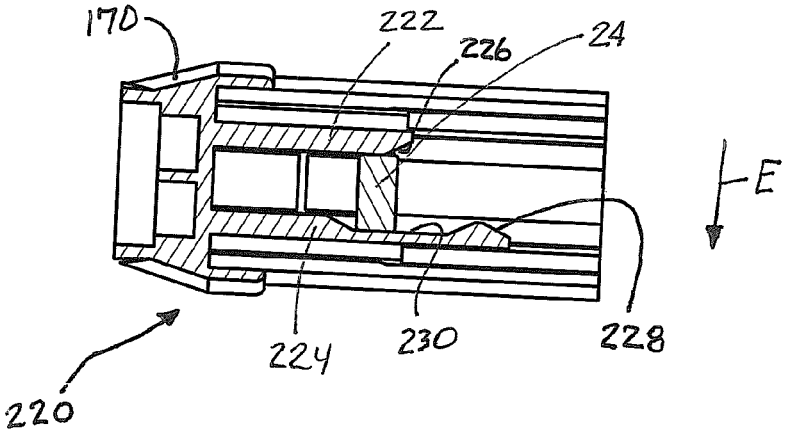
Fig. 18
Fig. 19
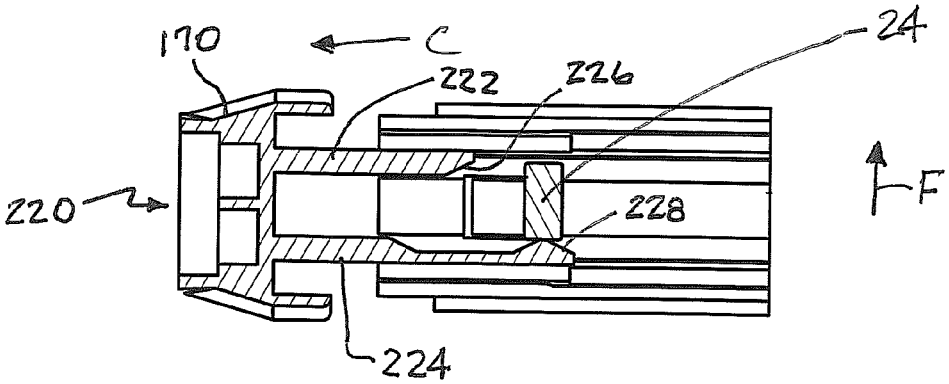

BULLPUP CONVERSION KIT FOR FIREARM

This application claims the benefit of U.S. Provisional Patent Application Ser. No. 61/396,190, filed 24 May 2010, and entitled "PUMP SHOTGUN CONVERSION KIT", the full disclosure of which is incorporated herein by reference.

TECHNICAL FIELD AND INDUSTRIAL APPLICABILITY OF THE INVENTION

The present invention relates generally to the firearm field and, more particularly, to a bullpup conversion kit for a firearm as well as to a firearm converted to a bullpup configuration.

BACKGROUND OF THE INVENTION

Bullpup conversion kits for firearms and firearms converted to a bullpup configuration are well known in the art. Examples of such kits and converted firearms are disclosed in, for example, U.S. Pat. No. 4,463,654 to Barnes et al, U.S. Pat. No. 4,601,123 to Swaringin et al, U.S. Pat. No. 4,677,781 to Lee, U.S. Pat. No. 4,869,008 to Rasmusen, U.S. Pat. No. 7,337,574 to Crandall et al and U.S. Pat. No. 7,356,958 to Wier. Among other modifications a bullpup conversion kit generally includes a recoil pad for replacing the standard butt stock of the firearm and a new forward trigger assembly that is operatively attached to the original trigger assembly of the firearm. A bullpup modification may shorten the length of a standard firearm by as much as 15 to 25 centimeters or more. The relatively great length of many conventional firearms including, for example, automatic and pump shotguns makes them difficult to handle at close range as a defense weapon. In contrast, when such firearms are modified to a bullpup configuration the firearm is converted into a tactical weapon ideally suited for use at close range such as for military combat or battle applications.

The present invention relates to a new and improved reversible bullpup conversion kit that may be used to convert a conventional firearm, such as a pump shotgun, to a shorter, bullpup configuration. Advantageously, the kit includes many improvement features enhancing the performance of the converted firearm in a number of ways including, but not limited to, the provision of a more efficient and effective connection between the trigger of the forward trigger assembly of the kit and the original firearm trigger. The conversion kit and converted firearm also incorporate other performance features including, but not limited to, a spent shell deflector, a dual trigger assembly including a safety trigger, an exposed slide release actuator and a safety interlock feature. Advantageously, the conversion kit may be retrofitted to a number of different makes and models of firearms. The kit is also lightweight. The kit is user friendly and may be used to easily and conveniently convert a conventional standard firearm to a bullpup configuration. Further, the conversion kit is fully reversible so that the firearm may be returned to its standard configuration from the bullpup configuration as desired by the user.

SUMMARY OF THE INVENTION

A bullpup conversion kit for a firearm includes a housing, a forward trigger assembly, a trigger actuator and a linkage connecting the forward trigger assembly with the trigger actuator. The trigger actuator includes a first locator plate, a second locator plate and a cam actuator that is positioned between the two locator plates. The cam actuator includes a primary trigger engagement surface that engages the standard trigger provided on the firearm to which the conversion kit is applied.

More specifically describing the invention, the trigger actuator includes two locator pins extending between the first and second locator plates and the cam actuator includes an elongated slot through which the locator pins extend. In addition, the linkage includes a first transfer bar and a second transfer bar. The cam actuator includes a first aperture and a second aperture. Further, the first locator plate includes a first elongated opening while the second locator plate includes a second elongated opening. The first end of the first transfer bar extends through the first elongated opening and engages in the first aperture and the second end of the second transfer bar extends through the second elongated opening and engages in the second aperture.

The forward trigger assembly includes a trigger block, a trigger and a trigger pin. The trigger block includes a channel that receives the trigger and allows free sliding movement of the trigger with respect to the trigger block. The trigger pin includes a third aperture and a fourth aperture. The first transfer bar includes a third end engaging in the third aperture and the second transfer bar includes a fourth end engaging in the fourth aperture. Thus, it should be appreciated that the two transfer bars connect the trigger and trigger pin of the forward trigger assembly with the cam actuator of the trigger actuator.

In accordance with yet another aspect, a firearm is converted and provided in a bullpup configuration. The converted firearm includes a firearm having a receiver carrying a primary trigger and a barrel. Further, the converted firearm includes a conversion kit attached to the firearm. The conversion kit includes a housing, a forward trigger assembly, a trigger actuator and a linkage connecting the forward trigger assembly with the trigger actuator. The trigger actuator includes a first locator plate, a second locator plate and a cam actuator positioned between the locator plates. The cam actuator includes a primary trigger engagement surface. Advantageously, the forward trigger assembly, trigger actuator and associated linkage provide for a smooth, efficient and reliable firing action that produces consistent performance even under the most adverse operating conditions as may be found out in the field.

In the following description there is shown and described a bullpup conversion kit and a firearm converted to a bullpup configuration. As it will be realized, the conversion kit and converted firearm are capable of other different embodiments and their several details are capable of modification in various, obvious aspects. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the conversion kit and the converted firearm and together with the description serve to explain certain principles thereof. In the drawings:

FIGS. 16 and 17 are respective detailed cross sectional views illustrating the slide actuator of the conversion kit in the rest and slide release engaging positions;

FIGS. 18 and 19 are respective detailed cross sectional views illustrating the operation of the safety interlock that holds the safety actuator of the firearm in the fire position yet moves the safety actuator into the safe position when the recoil pad assembly of the conversion kit is removed from the firearm;

Reference will now be made in detail to the present preferred embodiment of the conversion kit and converted firearm, an example of which is illustrated in the accompanying drawings.

DETAILED DESCRIPTION OF THE PREFERRED EMBODIMENTS OF THE INVENTION

Figure 2:
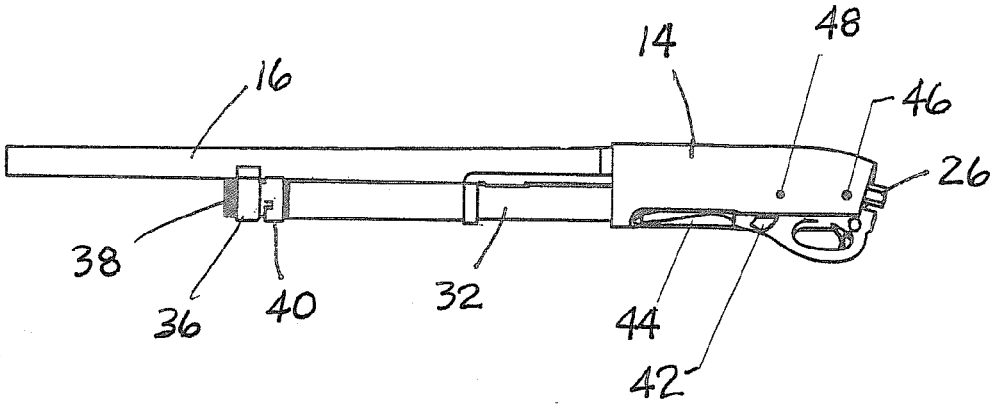
FIG. 2 is a left side elevational view of the standard or conventional pump shotgun illustrated in FIG. 1.
Figure 3:
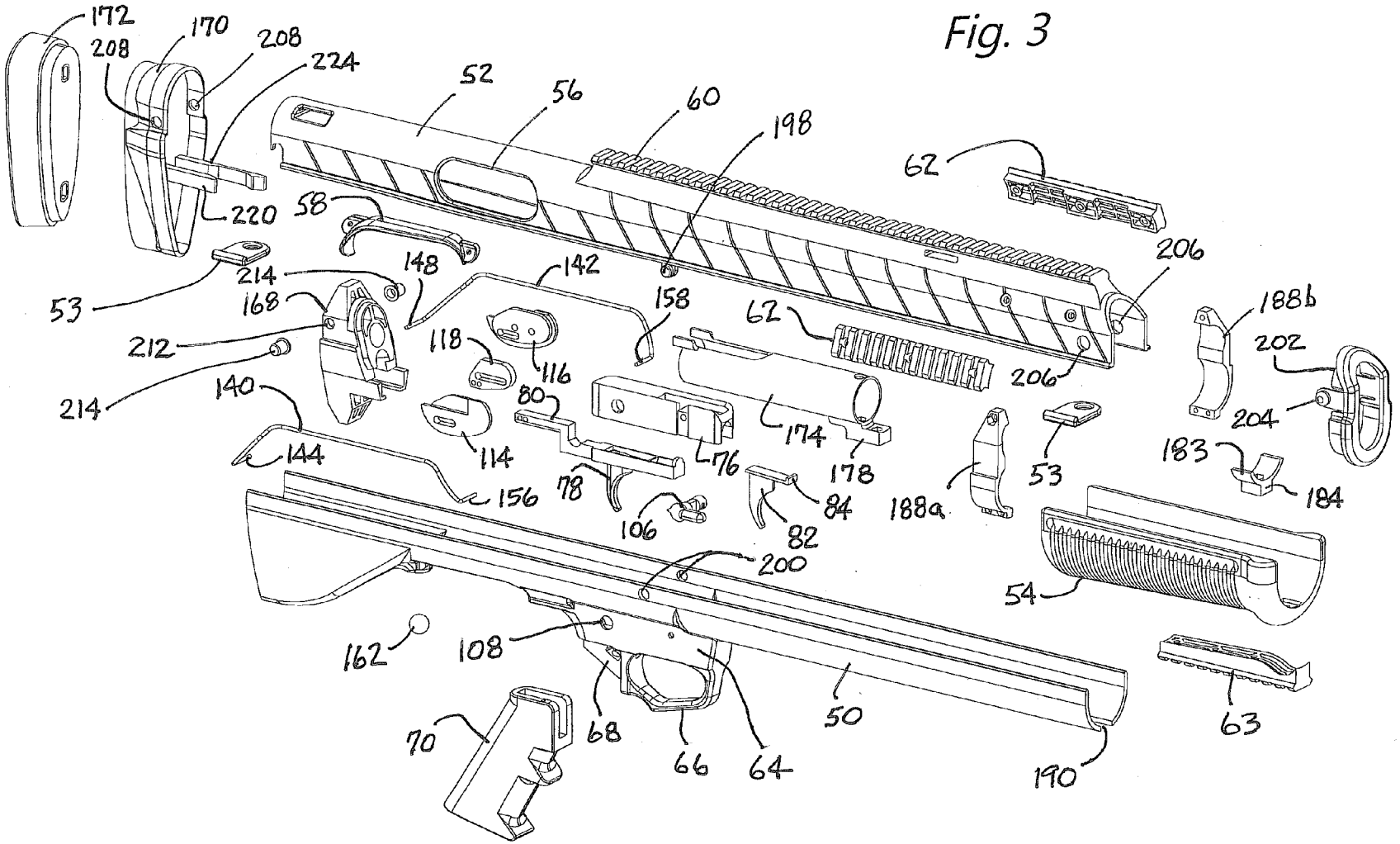
FIG. 3 is an exploded perspective view of a bullpup conversion kit used to convert the standard or convention pump shotgun illustrated in FIGS. 1 and 2 to a bullpup configuration.
Figure 4:
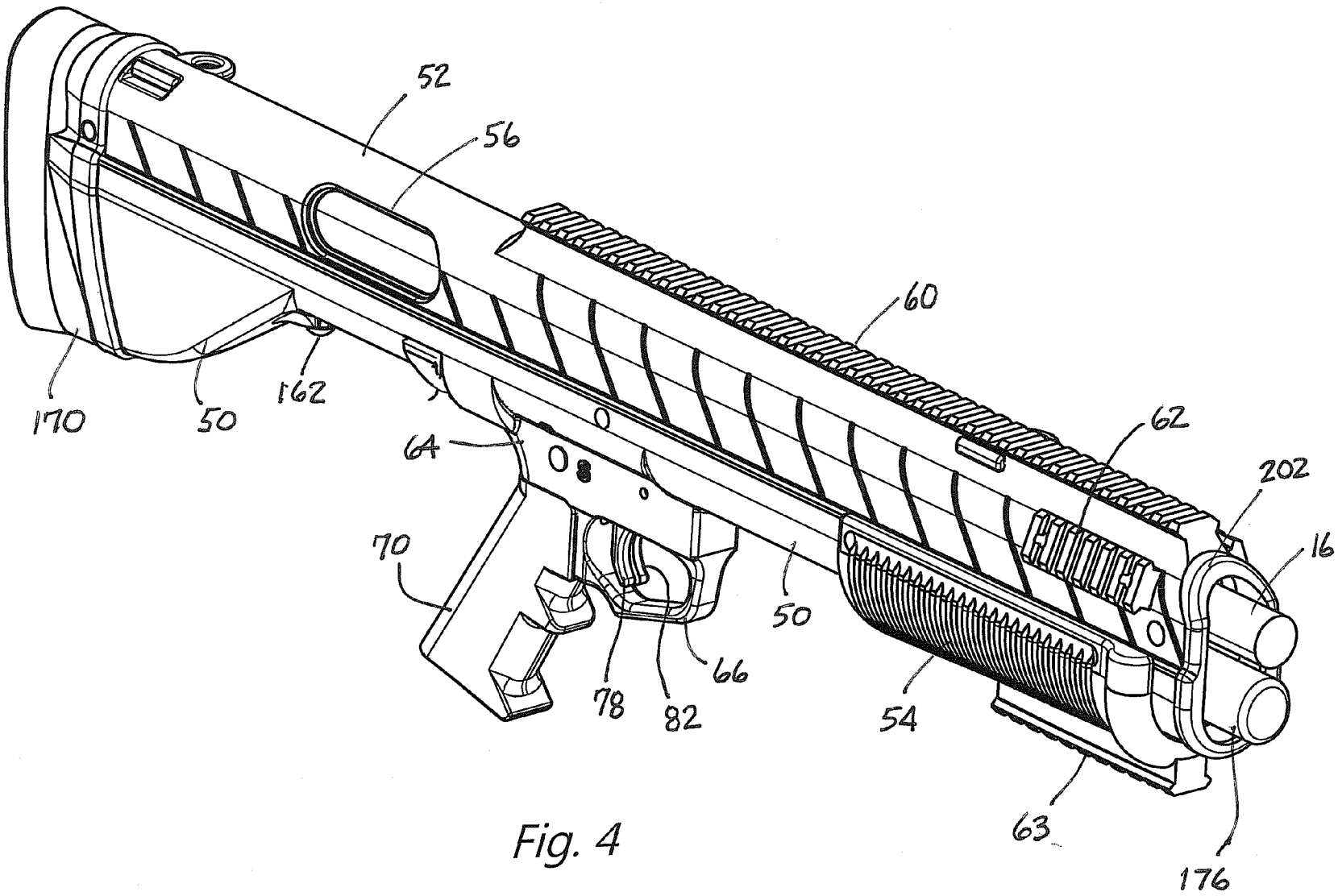
FIG. 4 is a right front perspective view of the pump shotgun illustrated in FIGS. 1 and 2 converted to a bullpup configuration.
Figure 5:
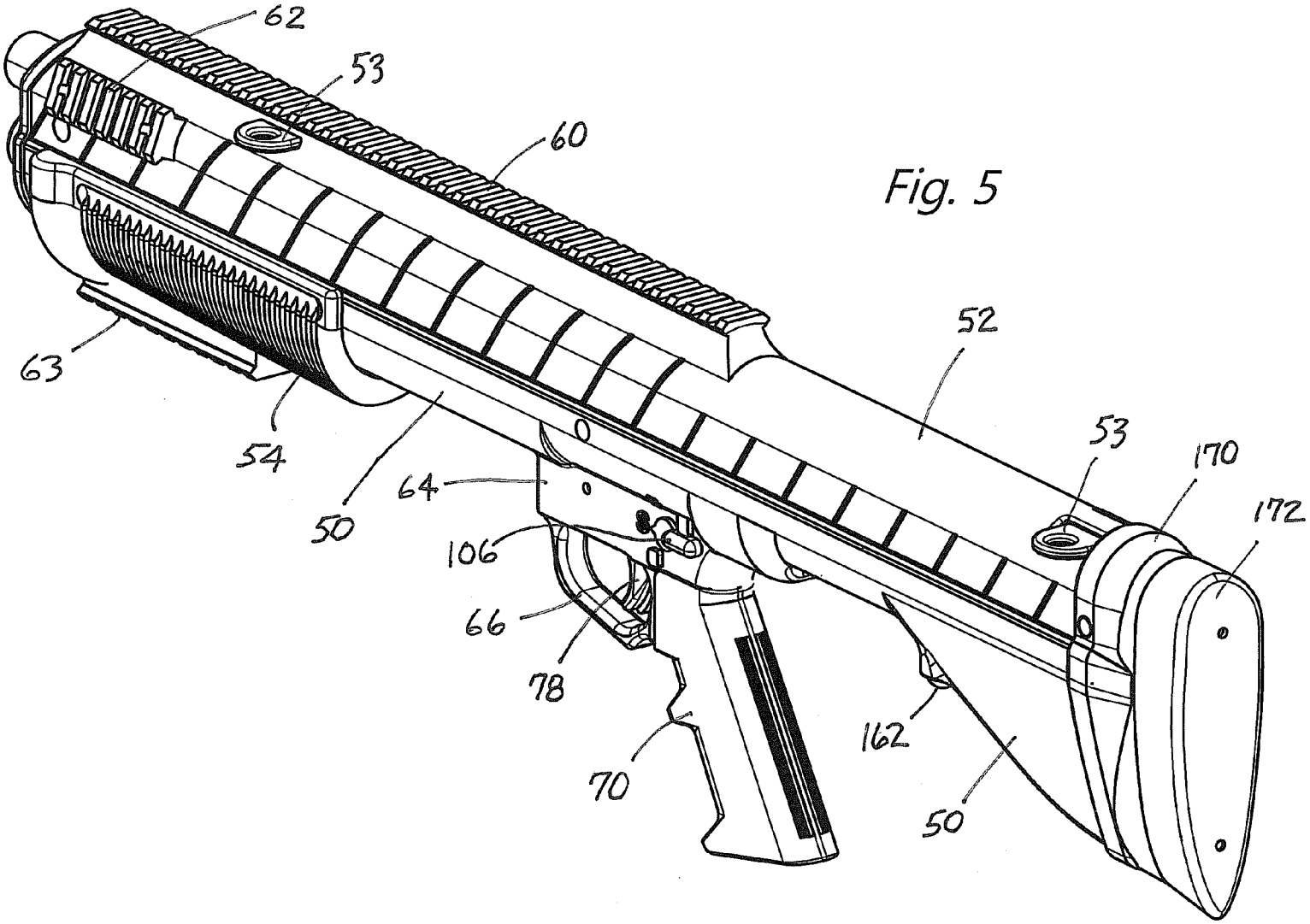
FIG. 5 is a left rear perspective view of the converted firearm.
Figure 6:
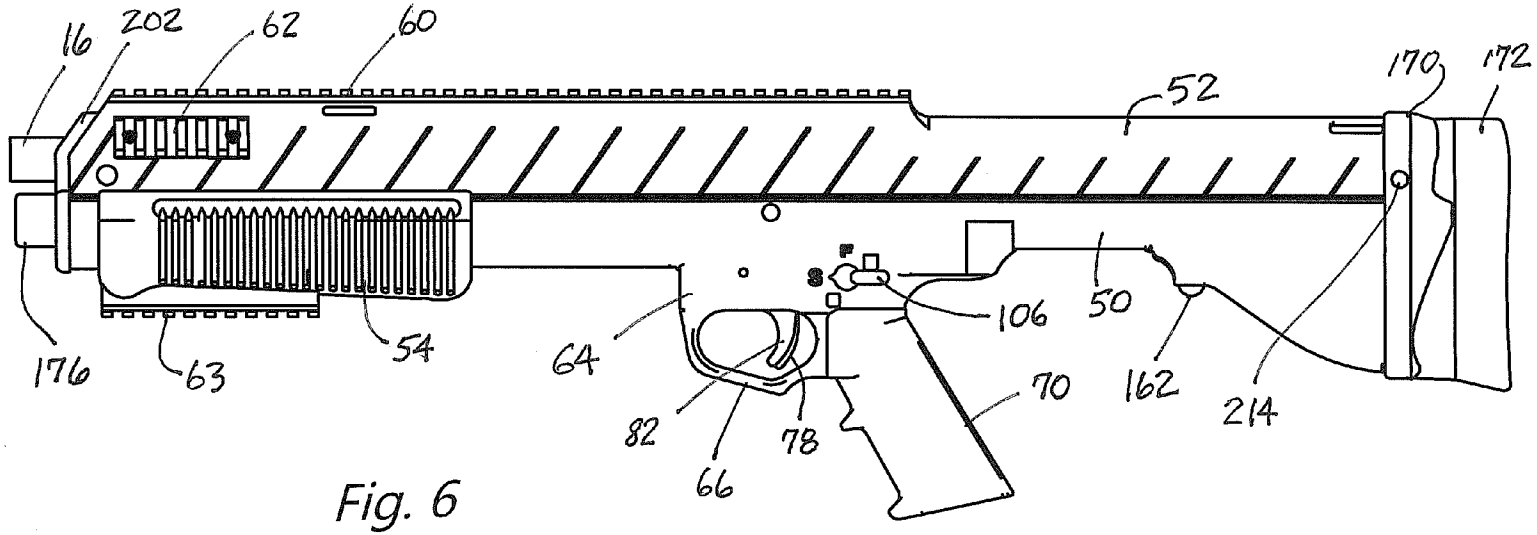
FIGS. 6 and 7 are respective left and right side elevational views of the converted firearm illustrated in FIGS. 4 and 5.
Figure 7:
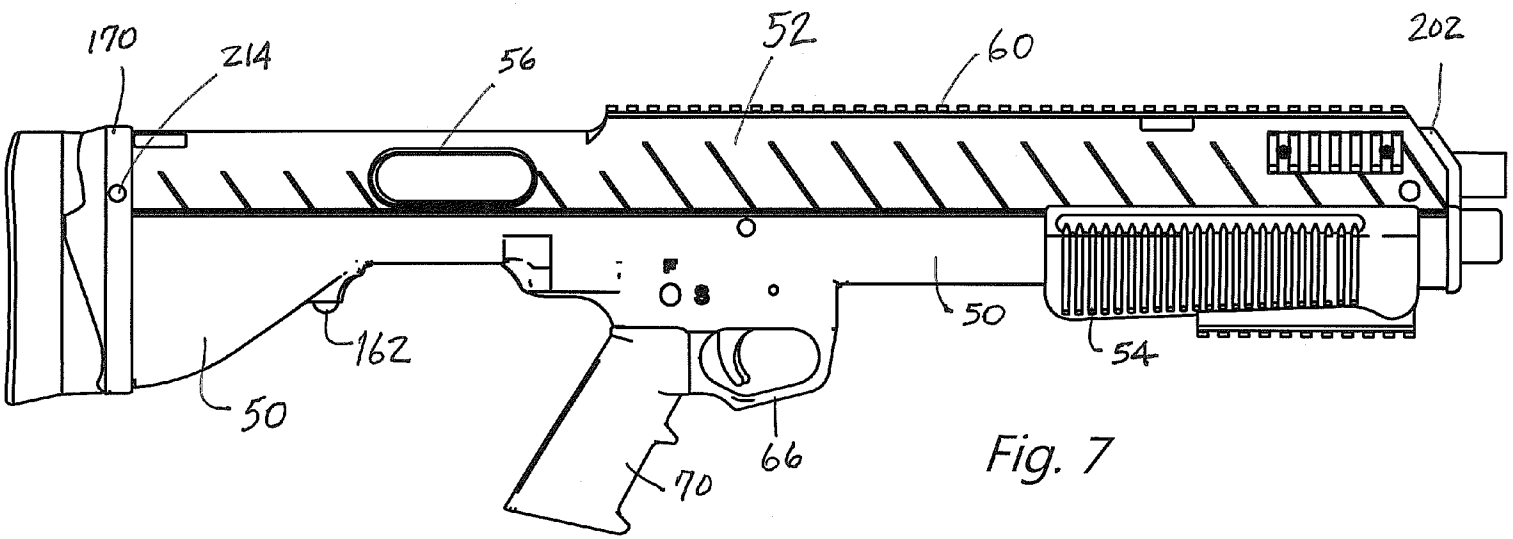

Reference is now made to the drawing figures illustrating the bullpup conversion kit 10 and converted firearm 100. The conversion kit 10 illustrated in FIG. 3 is attached to the conventional firearm 12 illustrated in FIGS. 1 and 2 in order to provide the bullpup conversion firearm 100 illustrated in FIGS. 4-7.

Figure 1:
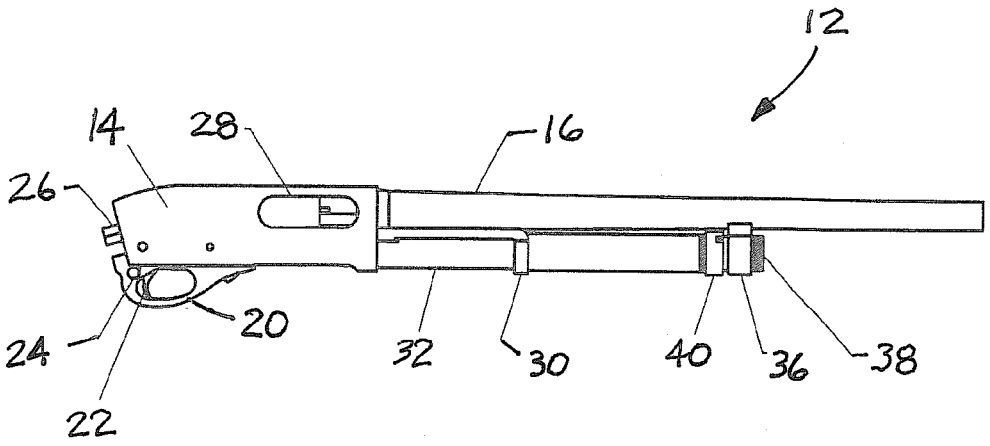
FIG. 1 is a right side elevational view of a standard or conventional pump shotgun with the fore grip and butt stock removed.

In the illustrated embodiment the conventional firearm 12 comprises a pump style shotgun. The shotgun 12 is illustrated in FIGS. 1 and 2 with the original fore grip and butt stock removed. The shotgun 12 includes a receiver 14 that is connected to a barrel 16 and a trigger assembly 18. The trigger assembly 18 includes a trigger guard 20, a trigger 22 and a safety 24. A rear stock mount 26 projects from the rear of the receiver 14. A port 28 for ejecting spent shells is provided in the right side of the receiver 14. The slide assembly 30 is moved back and forth manually to allow the receiver 14 to chamber a stored shotgun shell for firing in a manner known in the art. More specifically, in the illustrated embodiment the slide assembly 30 is moved in a rear position and then in a forward position for the purpose of chambering and ejecting the spent shell from the ejection port 28. The slide assembly 30 slides over the magazine tube 32 which stores shotgun shells to be held under spring pressure and fed into the firing position within the receiver 14. A barrel lug 36 is permanently mounted to the barrel 16 and allows the magazine tube 32 to be inserted in the correct position by sliding the threaded end through the barrel lug. The slide nut 40 normally holds the fore grip (now removed) in the correct orientation with the receiver 14 and the barrel 16.

FIG. 2 shows the opposite side of the firearm 12. The slide release 42 is depressed to allow the action to move from a locked to an unlocked position. A loading port 44 is provided to receive shotgun shells. The shells are pushed through the port 44 and loaded into the magazine tube 32 where those shells are stored until needed. FIG. 2 also illustrates receiver pins 46, 48 that are used to assemble the shotgun receiver 14. Reference is now made to FIG. 3 illustrating the conversion kit 10. As illustrated, the conversion kit 10 includes a housing comprising a lower shroud 50, an upper shroud 52 and a front grip 54. The upper shroud 52 includes a shell ejection port 56 with a cooperating shell deflector 58 and an upper rail 60. The shell deflector 58 directs ejected shells to the side and forward, away from the shooter. This allows the converted firearm 100 to be comfortably used by a left handed shooter. Optional side rails 62 may also be secured to the upper shroud 52. Further, an optional lower rail 63 may be connected to the front grip 54. Any number and type of accessories may be secured to the rails 60, 62, 63 including but not limited to gun sights, forward pistol grip, lights or the like.

Figure 9:
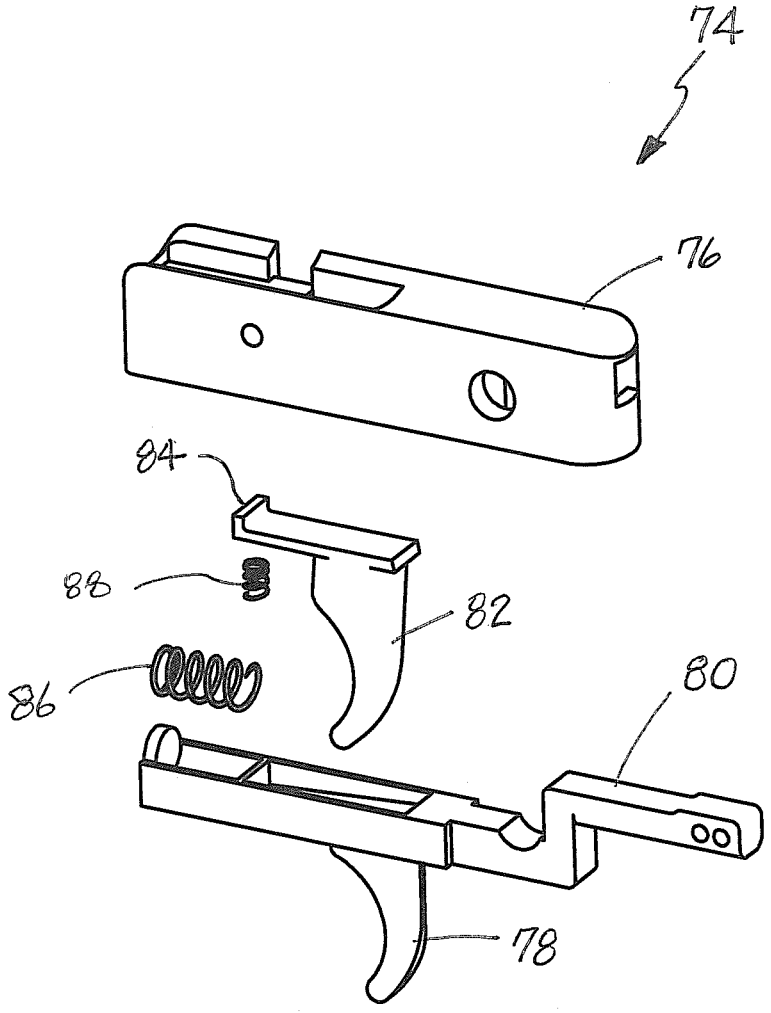
FIG. 9 is a detailed exploded view of the front trigger assembly of the conversion kit.
Figure 10:
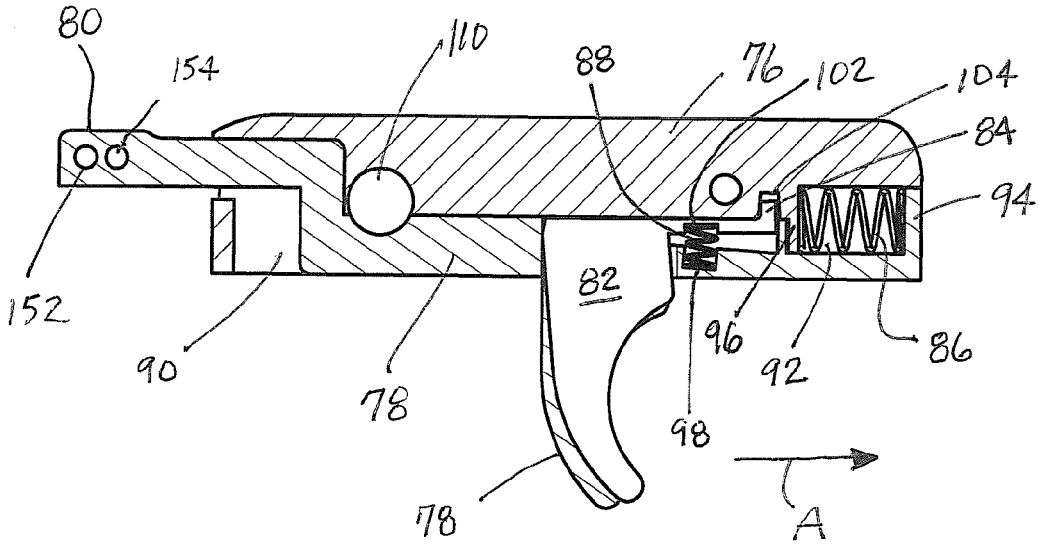

The lower shroud 50 includes an integral trigger assembly housing 64. The integral trigger assembly housing 64 includes a trigger guard 66 and a mounting block 68 adapted to receive the pistol grip 70 that may be secured in place by a fastener such as a screw (not shown) or other appropriate means. The integral trigger assembly housing 64 also includes a cavity 72, shown in FIG. 8, that receives and holds the forward trigger assembly generally designated by reference numeral 74 (see FIG. 9). The forward trigger assembly 74 includes a trigger block 76 and a trigger 78 having an integral trigger pin 80. In addition the forward trigger assembly 74 includes a safety trigger 82 having a lug 84. A trigger biasing spring 86 and safety trigger biasing spring 88 complete the forward trigger assembly 74. As illustrated in FIG. 10, the trigger 78 is received in a cavity 90 provided within the trigger block 76. The trigger biasing spring 86 is received in the channel 92 provided in the trigger 78. One end of the biasing spring 86 engages the end wall 94 of the trigger 78 while the opposite end engages the lug 96 provided on the trigger block 76. As a result, the compression spring 86 biases the trigger 78 with respect to the trigger block 76 in the direction of action arrow A toward a forward most, home or rest position.

As further illustrated in FIG. 10, the biasing spring 88 has a first end received in the socket 98 in the trigger 78 and a second end received in the socket 102 in the safety trigger 82. Thus, the biasing spring 88 simultaneously biases the lug 84 of the safety trigger 82 into the cavity or channel 104 in the trigger block 76. As should be appreciated, the engagement of the lug 84 in the cavity 104 functions to prevent sliding movement of the trigger 78 within the cavity 90 of the trigger block 76 thereby preventing the inadvertent discharge of the weapon when the user is not engaging the safety trigger 82 with his/her finger.

Figure 11:
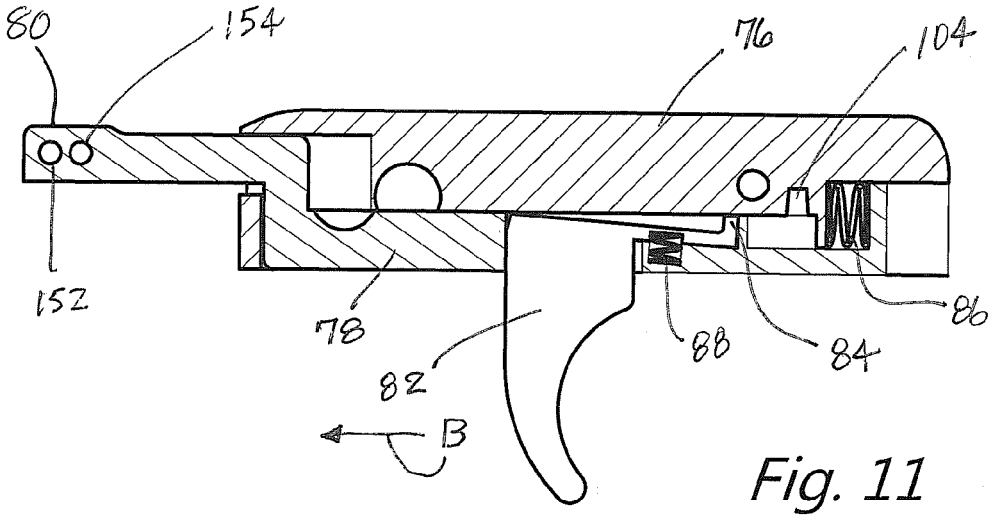
FIGS. 10 and 11 are detailed cross-sectional views of the front trigger assembly illustrating the safety trigger of that assembly in the safety and firing positions respectively.

Reference is now made to FIG. 11 illustrating the position of the trigger 78 during the firing of the weapon. More specifically, as the user engages the safety trigger 82 and applies pressure, the safety trigger pivots against the biasing force of the spring 88 and the lug 84 is withdrawn from the cavity 104. The lug 84 clears the cavity 104 when the safety-trigger 82 pivots into alignment with the trigger 78. At this point further pressure on the triggers 78, 82 causes the trigger 78 to slide in the cavity 90 with respect to the trigger block 76 in the direction of action arrow B against the force of the biasing spring 86. As the trigger 78 approaches the rearmost position illustrated in FIG. 11, the weapon is discharged.

It should be appreciated that the safety trigger 82 described and illustrated in FIGS. 10 and 11 is an optional safety feature of the conversion kit 10. In addition, the conversion kit 10 incorporates a standard safety comprising a safety pin 106 which extends through the opening 108 in the integral trigger assembly housing 64 and engages in the circular opening 110 in the trigger block 76 and trigger 78 when the trigger 78 is in the forward most position (see FIG. 10). When the safety pin 106 is in the safe position the pin fills the opening 110 thereby functioning to lock the trigger 78 in the forward or non-firing position. In contrast, when the safety pin 106 is rotated into the firing position, the trigger portion of the opening 110 is not filled by the safety pin and the trigger 78 may be depressed into the firing position illustrated in FIG. 11.

Figure 12:
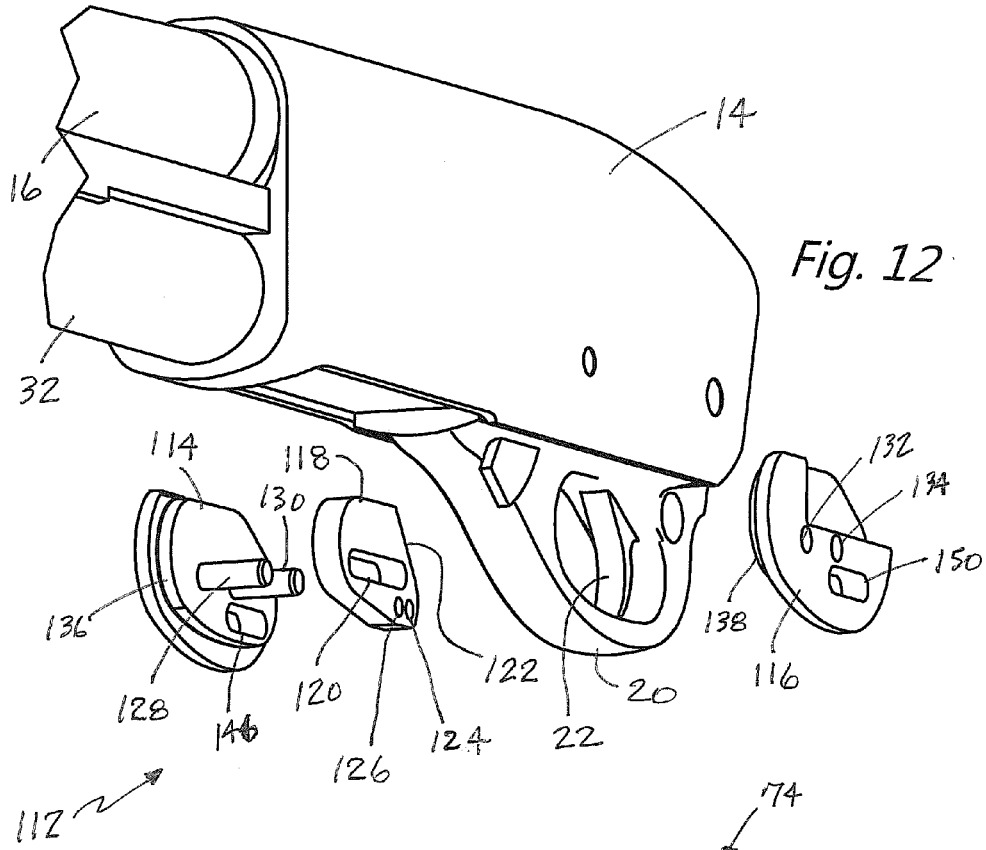
FIG. 12 is a detailed, exploded perspective view of the trigger actuator of the conversion kit.

Reference is now made to FIGS. 3 and 12 illustrating the trigger actuator 112 of the conversion kit 10. The trigger actuator 112 includes a first cam locator plate 114, a second cam locator plate 116 and a cam actuator 118. The cam actuator 118 includes an elongated locator slot 120, a trigger engagement surface 122 and first and second apertures 124, 126. The cam actuator 118 is sandwiched and captured within the trigger guard 20 between the locator plates 114, 116 with the trigger engagement surface 122 engaging or just clear of the trigger 22. More specifically, first and second locator pins 128, 130 project from the first locator plate, pass through the locator slot 120 and engage in apertures 132 and 134 in the second locator plate 116. As should be appreciated, the two locator plates 114, 116 include relief contours 136, 138 on the inner surfaces thereof adapted to fit within and substantially match the opening formed by the trigger guard 20. This enhances the connection and mounting on the trigger guard 20.

Figure 13:
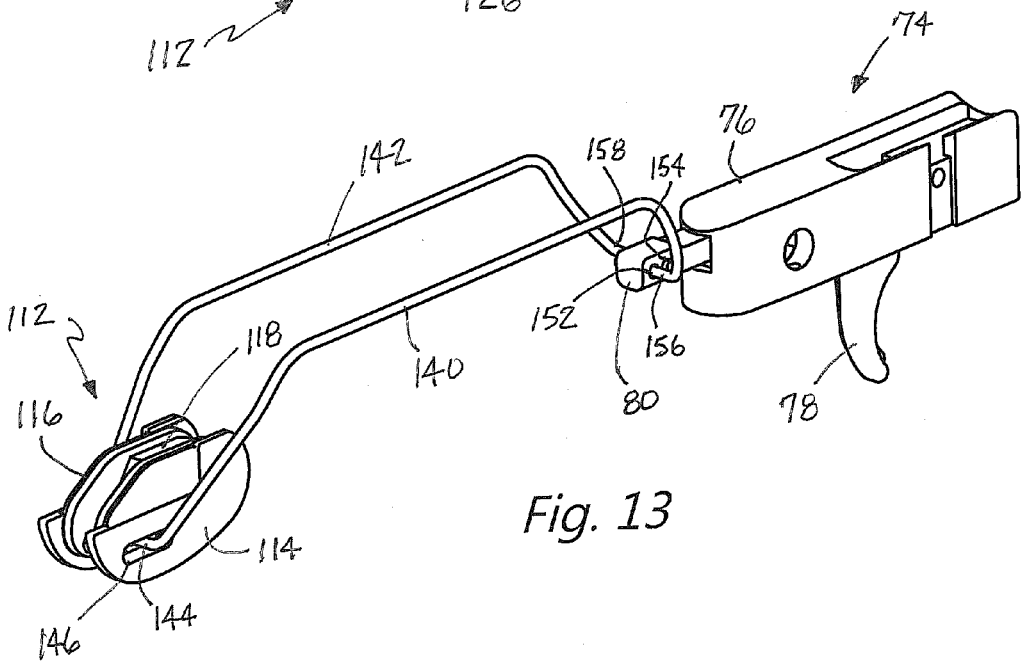
FIG. 13 is a detailed perspective view of the trigger pin of the forward trigger assembly connected to the cam actuator of the trigger actuator by means of a linkage including first and second transfer bars.

As best illustrated in FIG. 13, a linkage, in the form of first and second transfer bars 140, 142 connect the forward trigger assembly 74 to the trigger actuator 112. More specifically, the first end 144 of the first transfer bar 140 extends through the first elongated opening 146 in the first locator plate 114 and engages in the first aperture 124 in the cam actuator 118. The second end 148 of the second transfer bar 142 extends through the second elongated opening 150 in the second locator plate 116 and engages in the second aperture 136 in the cam actuator 118 (see also FIGS. 14 and 15). As illustrated in FIGS. 10, 11 and 13-15, the trigger pin 80 includes third and fourth apertures 152, 154 respectively. The third end 156 of the first transfer bar 140 is received in the third aperture 152 while the fourth end 158 of the second transfer bar 142 is received in the fourth aperture 154.

Figure 14:
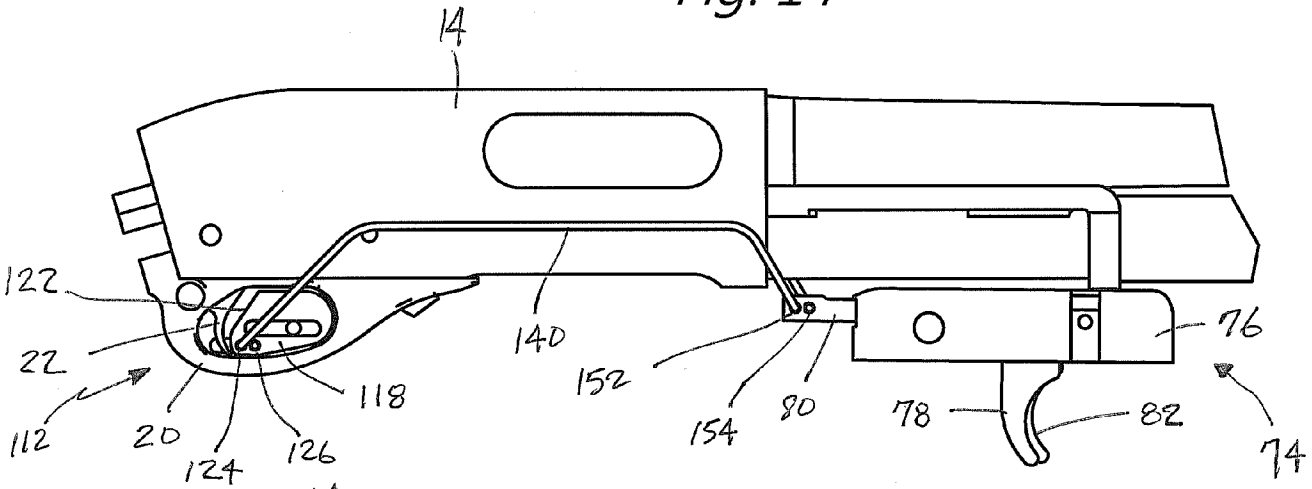
FIGS. 14 and 15 are respective side elevational views illustrating the forward trigger assembly and trigger actuator in the rest and firing positions.
Figure 15:
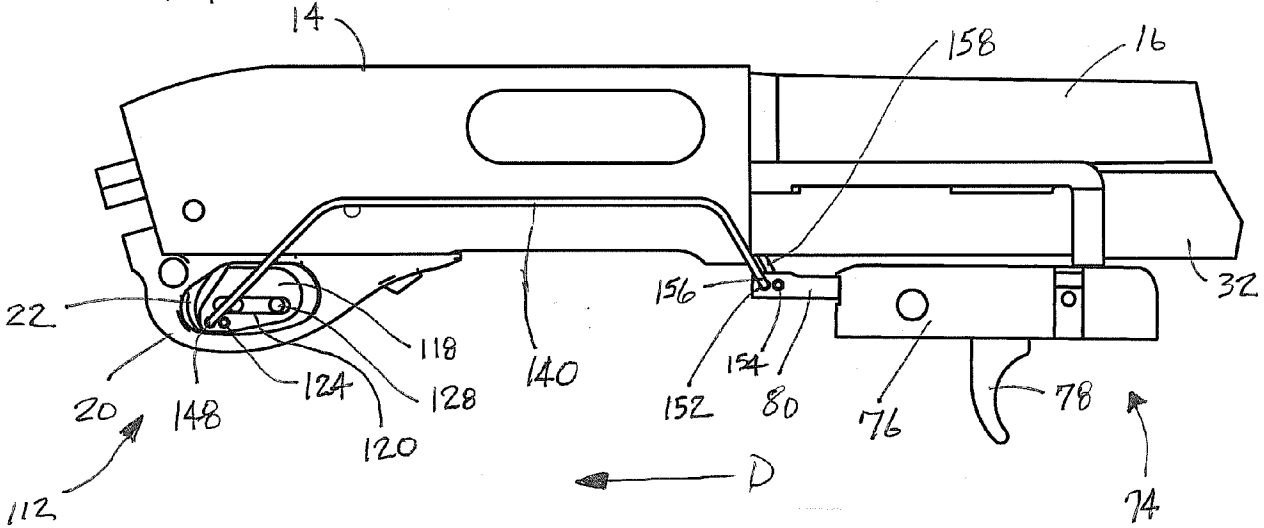

As should be appreciated from reviewing FIGS. 14 and 15, in operation, the forward trigger assembly 74 is provided forward of the receiver 14 and the receiver 14 fits between the two transfer bars 140, 142 which connect the trigger pin 80 of the trigger assembly 74 to the cam actuator 118 of the trigger actuator 112. The rest or non-firing position with the lug 84 of the safety trigger received in the cavity 90 of the trigger block 76 is illustrated in FIG. 14. In contrast, the firing position is illustrated in FIG. 16 with the trigger pin 80 in its rearmost position and the first and second transfer bars 140, 142 transferring that motion (note the action arrow D) to the cam actuator 118 so that the trigger engagement surface 122 engages the trigger 22 of the firearm 12 causing the firearm to discharge.

Advantageously, the forward trigger assembly 74, trigger actuator and connecting linkage in the form of the transfer bars 140, 142 provide a smooth, consistent and reliable firing action that optimizes weapon performance. Further, the return spring (not shown) of the trigger assembly 18 in the original firearm 12 and the return spring 86 of the forward trigger assembly 74 insure the quick, efficient and consistent return of the forward trigger assembly to the home position illustrated in FIGS. 10 and 14.

Figure 8:
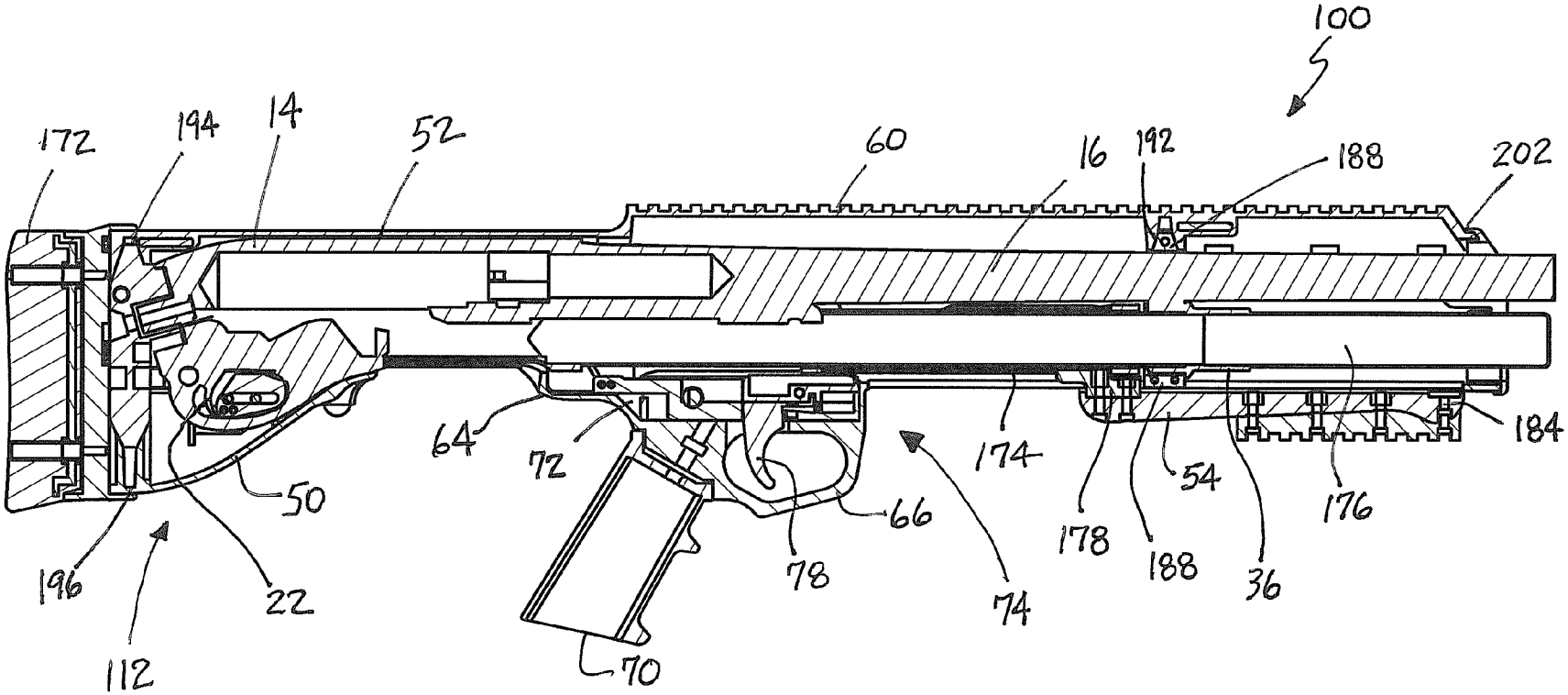
FIG. 8 is a detailed cross sectional view illustrating the connection of the upper and lower shrouds of the conversion kit housing to the firearm by means of front and rear adaptor blocks.

The conversion kit 10 also includes additional performance enhancing features. Reference is now made to FIGS. 8, 16 and 17 illustrating the slide actuating feature of the conversion kit 10. As illustrated, the lower shroud 50 includes a tapered socket 160 that receives and holds a slide actuator 162. More specifically, when the conversion kit 10 is properly mounted to the firearm 12, the slide actuator 162 is captured in the socket 160 between the slide release 42 of the firearm 12 and the smaller tapered end 164 of the socket 160. In the rest position, the slide release 42 holds the slide actuator 162, in the form of a ball, against the smaller tapered end 164 so as to seal the socket 160 and prevent the entry of dirt and debris. When the operator desires to operate the slide assembly 30 to eject the spent shell and load a new shell into the chamber the operator depresses the actuator 162 which simultaneously depresses the slide release 42 to allow movement of the slide assembly. When the operator releases the actuator 162, the slide release 42 returns the actuator 162 to the rest position illustrated in FIG. 16 again sealing the socket 160 from dirt and debris.

The connection of the conversion kit 10 to the firearm 12 will now be described in detail with reference to FIGS. 1, 3 and 8. The kit 10 includes a recoil pad assembly 166 comprising a rear mounting block 168, a recoil pad support 170 and a recoil pad 172. The rear mounting block 168 is secured to the rear stock mount 26 of the firearm 12 by means of a screw fastener (not shown). The kit 10 also includes a slide spacer tube 174 that is connected to the slide assembly 30 of the firearm 12 and held in position by the slide nut 40. A magazine extension tube 176 is threaded onto the threaded end 38 of the magazine tube 32 to increase the ammunition capacity of the firearm 12.

As further illustrated in FIGS. 3 and 8, the kit 10 also includes front adapter block 188 incorporating two sections 188*a*, 188*b* that are connected together by screw fasteners (not shown) so as to engage the barrel 16 and magazine tube 32 directly behind the barrel lug 36. With the front mounting block 188 and rear mounting block 168 properly secured to the firearm 12, the upper and lower shrouds 50, 52 may now be secured in position to form the outer housing of the converted firearm 100. First, the forward trigger assembly 74 is assembled as illustrated in FIG. 10 and the trigger actuator 112 is assembled on the trigger assembly 18 of the firearm 12 (see FIGS. 12 and 14). The first and second transfer bars 140, 142 are then connected to the forward trigger assembly 74 and trigger actuator 112 as illustrated in FIG. 13 to provide connection between the trigger pin 80 and the cam actuator 118.

The lower shroud 50 is then positioned over the bottom of the firearm 12 so that the forward trigger assembly 74 is received in the cavity 72 of the integral trigger assembly housing 64 and the slide actuator 162 is captured in the socket 160. The safety pin 106 is then inserted through the aperture 108 into the aperture 110 of the trigger assembly 74. When properly seated a grip mounting lug 178 provided on the slide spacer tube 174 projects through the elongated slot 190 in the lower shroud 50 so as to allow connection to the fore grip 54. More specifically, the grip mounting lug 178 is received in a cavity 180 in the fore grip 54 and the two are connected by a fastener (not shown) such as two screws. A spacer 184 includes a block section received in the cavity 186 at the front of the fore grip 54. An arcuate rest portion 183 engages against the magazine extension tube 176 when the fore grip 54 is properly seated and secured to the slide spacer tube 174. When properly connected, the fore grip 54 may be engaged by the operator to operate the slide assembly 30 of the firearm 12. The arcuate rest portion 183 of the spacer 184 smoothly slides along the magazine extension tube 176 during movement of the slide assembly 30 while supporting the fore grip in position.

Next the upper shroud 52, with sling clips 53, is secured to the lower shroud 50. As best illustrated in FIG. 8, a forward alignment channel 192 in the upper shroud receives the upper portion of the front mounting block 188 while a rearward alignment channel 194 in the upper shroud receives the rear mounting block 168. As should be appreciated a similar alignment channel 196 in the lower shroud 50 receives the lower end of the rear mounting block 168. When properly seated on the front and rear mounting blocks 188, 168, opposed resilient detents 198 on the upper shroud 52 are aligned with and received in opposed apertures 200 in the lower shroud 50. An end cap 202 is received over the barrel 16 and magazine extension tube 176 to secure the upper and lower shrouds 52, 50 together at the very front of the converted firearm 100. Opposed resilient tabs 204 on the end cap 202 engaged in opposed apertures 206 in the upper shroud 52 to complete the connection. Of course, while the tabs 204 are shown, other fasteners such as screws could be utilized if desired.

The recoil pad 172 is secured to the recoil pad support 170 by means of two screws (not shown). The recoil pad support 170 and attached pad 172 are then secured to the butt end of the converted firearm 100. Specifically, the recoil pad support 170 is positioned around the upper and lower shrouds 52, 50 until the apertures 208 in the recoil pad support 170 are aligned with the half apertures 210 in the upper shroud 52 and the opposed apertures 212 in the rear mounting block 168. The connecting pins 214 are then positioned in the aligned apertures 208, 210, 212 to complete the connection of the kit 10 to the firearm 12 and form the converted firearm 100.

Reference is now made to FIGS. 18 and 19 which illustrate the safety interlock feature 220 of the present invention adapted to cooperate with a safety 24 as found on firearms like those manufactured by Remington Arms Company, Inc. More specifically, the safety interlock 220 comprises a first resilient prong 222 and a second resilient prong 224 on the recoil pad support 170. The first resilient prong includes a first cam 226 while the second resilient prong includes a second cam 228. The second cam 228 is V-shaped. As the recoil pad 170 is secured over the shrouds 52, 50 the prongs 222, 224 are pushed through openings in the rear mounting block 168. As the recoil pad support 170 is moved toward the fully seated position, the V-shaped cam 228 on the second prong 224 slides past the safety 24 of the firearm 12. Next, the first cam 226 on the first prong 222 engages the safety 24 of the firearm 12 forcing the safety into the fire position (that is, forces safety 24 in direction of action arrow E). A clearance channel 230 provided in the second prong 224 provides the necessary clearance to allow movement of the safety 24 fully into the firing position. It should be appreciated that when the recoil pad support 170 is pinned into position on the shrouds 52, 50 by the connecting pins 214, the first prong 220 positively holds the safety 24 of the firearm 12 in the firing position thereby ensuring proper operation of the converted firearm 100 and eliminating any need to access this now internal component in order to fire the firearm 12.

Reference is now made to FIG. 19 illustrating the removal of the recoil pad support 170. When one wishes to break down the converted firearm 100 for cleaning or removal of the conversion kit 10, the connecting pins 214 are removed and the recoil pad support 170 is displaced in the direction of action arrow C so as to remove it from the upper and lower shrouds 52, 50. As the recoil pad 172 is moved in this direction, the second cam 228 on the second prong 224 engages the safety 24 and displaces the safety 24 into the safe position (note action arrow F). Thus the safety 24 of the firearm 12 is engaged after the recoil pad support 170 has been removed during breakdown of the converted firearm 110.

Figure 23:
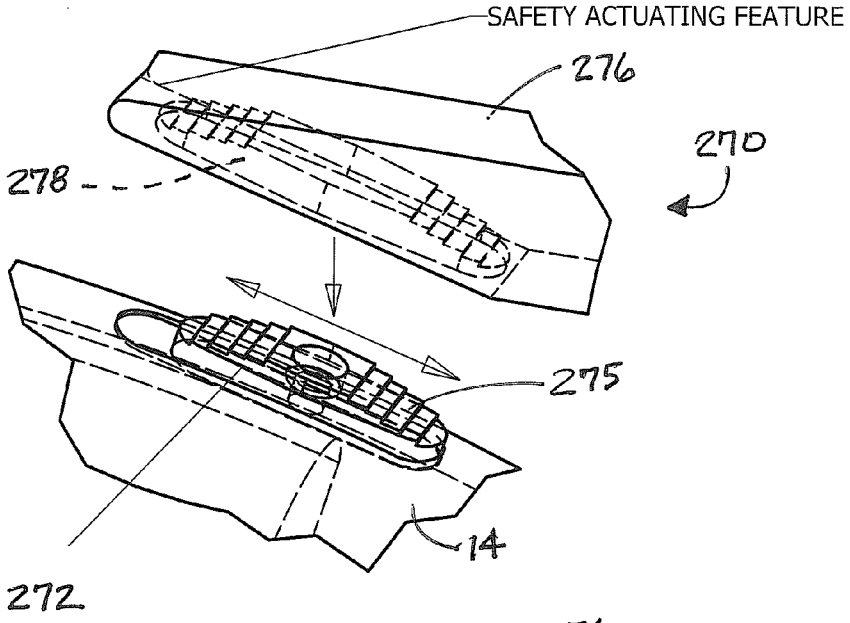
FIG. 23 is a detailed perspective view of the safety actuator bar that engages the safety slide actuator.
Figure 22:
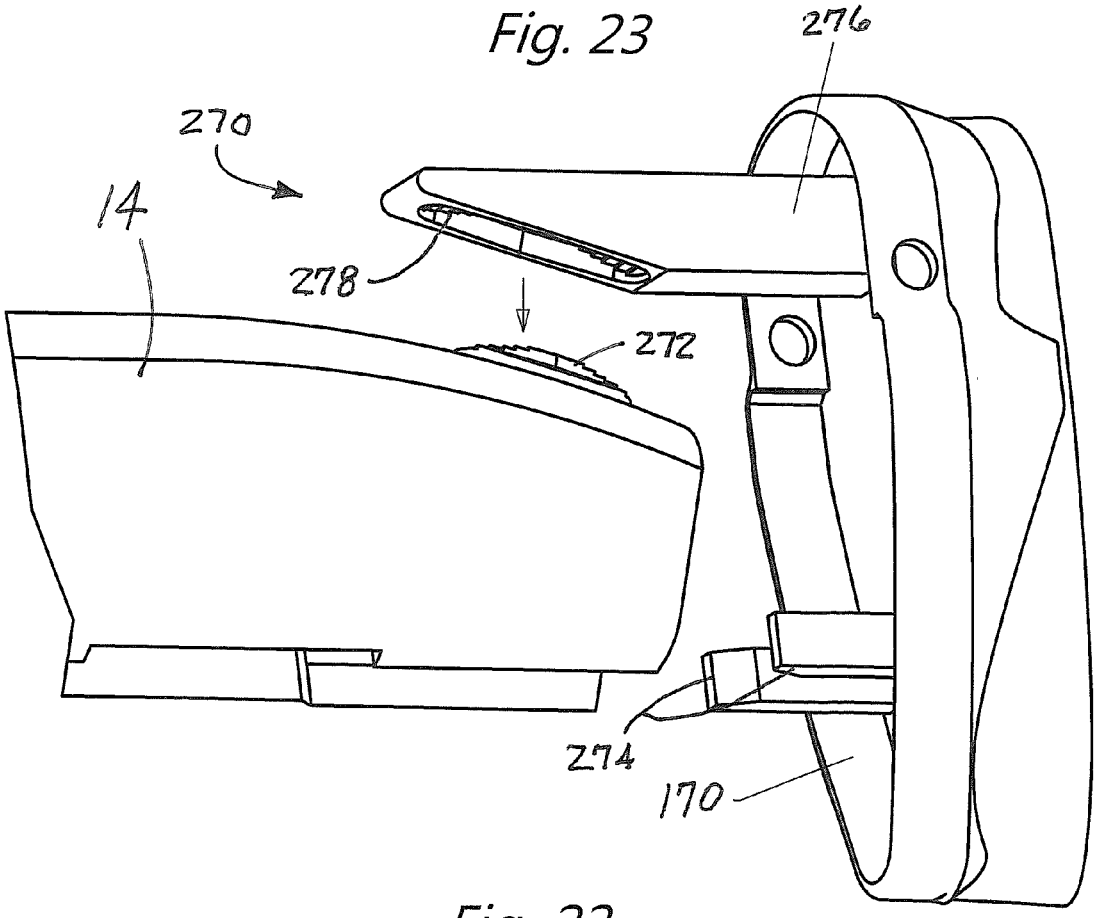
FIG. 22 is a detailed perspective view showing an alternative embodiment of the safety interlock for use with firearms having a safety slide actuator mounted on the rear of the receiver.

Reference is now made to FIGS. 22 and 23 illustrating an alternative embodiment of safety interlock 270 used with firearms 12 equipped with a rear mounted safety slide actuator 272 such as found on shotguns manufactured by O.F. Mossberg & Sons Inc. In this embodiment, the recoil pad 170 includes resilient retention clips 274 and a safety actuator bar 276. Safety actuator bar 276 includes a contoured cavity 278 designed to receive and rest over the contoured surface 275 of the safety slide actuator 272 on the firearm 12.

As the recoil pad support 170 is mounted on the shrouds 50, 52 and the rear mounting block 168, the cavity 278 of the safety actuator bar 276 is received over and nests with the safety slide actuator 272 which is moved into and held in the firing position. In contrast, when the recoil pad support 170 is withdrawn to breakdown the converted firearm 100, the safety actuator bar 276 slides the safety slide actuator 272 into the safety position.

Figure 21:
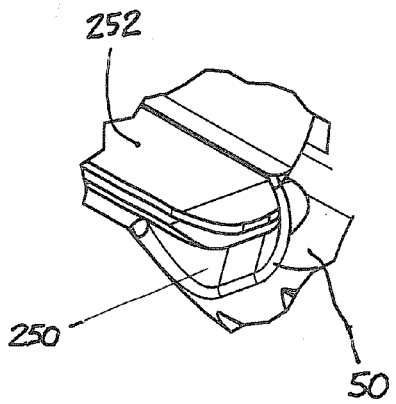
FIG. 21 is a detailed perspective view illustrating a loading ramp for facilitating the loading of shells into the converted firearm.
Figure 8A:
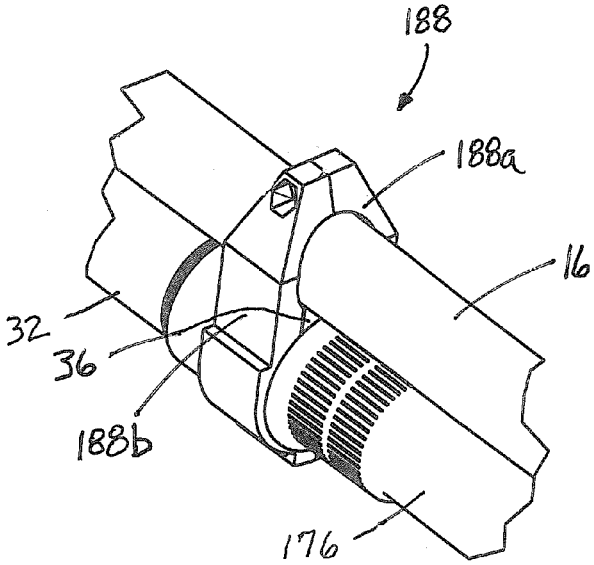
FIG. 8A is a detailed perspective view illustrating the connection of the front mounting block to the barrel and magazine tube adjacent the barrel lug.
Figure 20:
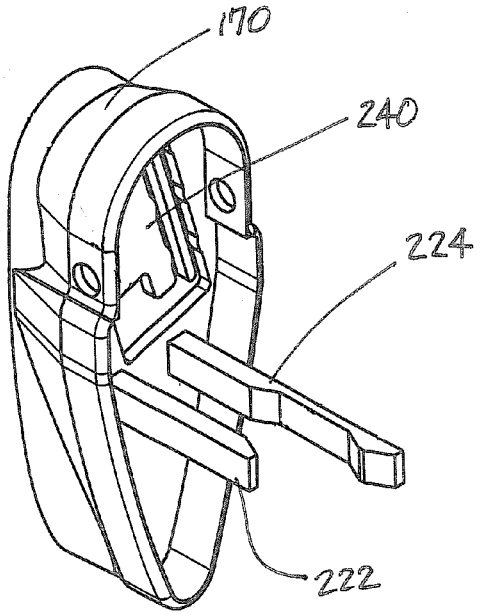
FIG. 20 is a detailed perspective view illustrating the tool pocket provided in an interior cavity of the recoil pad support.

The foregoing description of the preferred embodiments of the present invention have been presented for purposes of illustration and description. It is not intended to be exhaustive or to limit the invention to the precise form disclosed. Obvious modifications or variations are possible in light of the above teachings. For example, as illustrated in FIG. 20, the recoil pad support 170 may include a tool pocket 240 for holding any allen wrenches or other tools necessary to break down the converted firearm 100 in the field. In addition, as illustrated in FIG. 21, a loading ramp 240 may be connected to the lower shroud 50 around the loading port 252. The loading ramp 250 is shaped and sloped to better direct shells through the loading port 252 in the shroud 50 and the loading port 44 in the firearm 12.

Further, while the illustrated firearm 12 is a pump shotgun, it should be appreciated that the conversion kit 10 is easily adapted to convert other types of shotguns and firearms to bullpup configurations. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A bullpup conversion kit for a firearm, comprising:

a housing;

a forward trigger assembly;

a trigger actuator;

a firearm safety interlock that engages and controls a safety actuator on the firearm to which said kit is attached; and a linkage connecting said forward trigger assembly with said trigger actuator;

wherein said trigger actuator includes a first locator plate, a second locator plate and a cam actuator positioned between said locator plates, said cam actuator including a primary trigger engagement surface.

2. The kit of claim 1, wherein said trigger actuator further includes two locator pins extending between said first and second locator plates and said cam actuator includes an elongated slot through which said locator pins extend.

3. A bullpup conversion kit for a firearm, comprising:

a housing;

a forward trigger assembly;

a trigger actuator, wherein said trigger actuator includes a first locator plate, a second locator plate and a cam actuator positioned between said locator plates, said cam actuator including a primary trigger engagement surface; and a linkage connecting said forward trigger assembly with said trigger actuator, wherein (1) said linkage includes a first transfer bar and a second transfer bar; (2) said cam actuator includes a first aperture and a second aperture; (3) said first locator plate includes a first elongated opening; and (4) said second locator plate includes a second elongated opening wherein a first end of said first transfer bar extends through said first elongated opening and engages in said first aperture and a second end of said second transfer bar extends through said second elongated opening and engages in said second aperture.

4. The kit of claim 3, wherein said forward trigger assembly includes a trigger block, a trigger and a trigger pin, said trigger block including a channel that receives said trigger and allows free sliding movement of said trigger with respect to said trigger block.

5. The kit of claim 4, wherein said trigger pin includes a third aperture and a fourth aperture, said first transfer bar including a third end engaging said third aperture and said second transfer bar including a fourth end engaging said fourth aperture.

6. The kit of claim 5, wherein said forward trigger assembly further includes a safety trigger, a biasing spring and a projecting lug and said trigger block includes a cavity, said biasing spring biasing said lug into said cavity when said safety trigger is not engaged by an operator whereby inadvertent operation of said trigger is defeated.

7. A bullpup conversion kit for a firearm, comprising:

a housing;

a forward trigger assembly;

a trigger actuator wherein said trigger actuator includes a first locator plate, a second locator plate and a cam actuator positioned between said locator plates, said cam actuator including a primary trigger engagement surface;

a linkage connecting said forward trigger assembly with said trigger actuator; and a slide release actuator;

and a spring, said slide release actuator being biased by said spring so as to project through an actuator opening provided in said housing.

8. The kit of claim 7, wherein said slide release actuator includes a lug that engages a slide release on the firearm to which said kit is attached.

9. The kit of claim 7, further including a firearm safety interlock that engages and controls a safety actuator on the firearm to which said kit is attached.

10. The kit of claim 1, further including a recoil pad assembly including a rear adaptor block, a recoil pad support and a recoil pad.

11. The kit of claim 10, wherein said safety interlock is carried on said recoil pad assembly.

12. The kit of claim 11, wherein said safety interlock comprises a first resilient prong and a second resilient prong.

13. The kit of claim 12, wherein said first prong has a first cam and said second prong has a second cam.

14. The kit of claim 13, wherein when said recoil pad support is properly seated on the firearm, said first prong engages a safety actuator on the firearm so as to maintain the safety actuator in an off position and allow discharge of the firearm.

15. The kit of claim 14, wherein when said recoil pad support is removed from said firearm, said second prong engages the safety actuator on the firearm so as to displace the safety actuator into an on position and thereby defeat inadvertent discharge of the firearm.

16. The kit of claim 15, wherein said second cam is V-shaped and said second cam includes a clearance channel for the safety actuator when held by said first prong in the off position.

17. A firearm converted to a bullpup configuration; comprising:

a firearm including a receiver carrying a primary trigger and a barrel;

a conversion kit attached to said firearm, said conversion kit including a housing, a forward trigger assembly, a firearm safety interlock that engages and controls a safety actuator on the firearm to which said kit is attached, a trigger actuator and a linkage connecting said forward trigger assembly with said trigger actuator wherein said trigger actuator includes a first locator plate, a second locator plate and a cam actuator positioned between said locator plates, said cam actuator including a primary trigger engagement surface.

18. The converted firearm of claim 17, wherein said forward trigger assembly further includes a trigger, a safety trigger, a biasing spring and a projecting lug and a trigger block having a cavity, said biasing spring biasing said lug into said cavity when said safety trigger is not engaged by an operator whereby inadvertent operation of said trigger is defeated.

19. The converted firearm of claim 17, wherein said firearm includes a slide and a slide release and said conversion kit includes a slide release actuator that projects from an actuator opening in said housing whereby an operator may activate said slide release of said firearm.

* * * * *